US008960744B2

(12) United States Patent
Swanger

(10) Patent No.: US 8,960,744 B2
(45) Date of Patent: Feb. 24, 2015

(54) HANDHELD, INTEGRATED MULTIFUNCTION SHOVEL

(76) Inventor: Shane Swanger, Eagle Mountain, UT (US)

( * ) Notice: Subject to any disclaimer, the term of this patent is extended or adjusted under 35 U.S.C. 154(b) by 0 days.

(21) Appl. No.: 13/342,138

(22) Filed: Jan. 2, 2012

(65) Prior Publication Data

US 2013/0168983 A1 Jul. 4, 2013

(51) Int. Cl.
*A01B 1/00* (2006.01)
*A01D 9/00* (2006.01)

(52) U.S. Cl.
USPC ..... 294/53.5

(58) Field of Classification Search
USPC ..... 294/49, 51, 53.5, 54.5, 176; 37/265, 37/267, 284–285
See application file for complete search history.

(56) References Cited

U.S. PATENT DOCUMENTS

| | | | | | |
|---|---|---|---|---|---|
| 1,202,791 | A * | 10/1916 | Brownstein | 37/267 |
| 4,722,512 | A * | 2/1988 | Lighthizer | 254/131.5 |
| 4,865,372 | A * | 9/1989 | Gabriel | 294/49 |
| 5,511,328 | A * | 4/1996 | Fingerer et al. | 37/285 |
| 5,791,072 | A * | 8/1998 | Schbot | 37/278 |
| 6,029,998 | A * | 2/2000 | Woodard | 280/819 |
| 8,256,809 | B2 * | 9/2012 | Coutu | 294/51 |
| 2008/0185856 | A1 * | 8/2008 | DeWinter | 294/53.5 |

* cited by examiner

*Primary Examiner* — Stephen Vu
(74) *Attorney, Agent, or Firm* — Steven Rinehart

(57) ABSTRACT

A multifunctional shovel is disclosed, comprising an elongated handle hingedly affixed to the reverse face of the shovel body such that the shovel body rotates axially around the distal end of the handle. In various embodiments, the shovel body comprises a plurality of ground engaging edges, such as a scrapper and plow, which can be positioned for ground engagement by rotating the target edge of shovel body into position around the distal end of the handle. The shovel also comprises a hinge and locking mechanism in some embodiments. The components are all of sufficient rigidity and durability to withstand compressive and tensile forces imposed on the shovel.

6 Claims, 7 Drawing Sheets

HANDHELD, INTEGRATED MULTIFUNCTION SHOVEL

FIELD OF THE INVENTION

This invention relates to tools, and more particularly relates to improved multifunctional shovels.

BACKGROUND

Description of the Related Art

Standard shovel and tilling implements have been known in the art since time immemorial. Typical shovel implements comprise a shovel body (commonly called a blade) and an elongated rigid, usually cylindrical handle for transferring force from an operator's hands to the tool implement or shovel body affixed to the handle. Shovel bodies are often convex or cup-shaped for receiving aggregate, coal, mulch, and the like, during lifting movements.

Typically, shovel bodies are formed to serve a predetermined purpose and shaped for optimal efficiency with a predetermined target matter. For instance, a coal shovel or snow shovel may be formed with a wide, obtuse scoop for gathering large amount of snow or coal quickly, while an entrenching shovel may have a sharper mouth for cutting into compacted soil and aggregate before removal. Snow shovels consequently are not efficient in removing densely packed target materials, such as ice, which requires a much sharper scoop mouth; while entrenching shovels are also not efficient in removing snow.

For this reason, operators needing to remove both snow and ice from residential driveways must usually make use of a plurality of implement to effectively remove snow and ice from a target area. There exists no efficient implement in the art with both wide and sharp scoop mouths. It is the same for operators needing to work with other substances.

What is needed is an improved transformable shovel, which integrates more than one type of mouth, shovel body or leading edge, and which allows an operator to more efficiently clear a target area by rotating between implements.

SUMMARY

From the foregoing discussion, it should be apparent that a need exists for an integrated, multifunction shovel. Beneficially, such an apparatus would integrate more than one scoop type, and allow an operator to rotate between these implements.

The present invention has been developed in response to the present state of the art, and in particular, in response to the problems and needs in the art that have not yet been fully solved by currently available shovels. Accordingly, the present invention has been developed to provide an apparatus that overcomes many or all of the above-discussed shortcomings in the art.

The apparatus is provided with a plurality of components or modules configured to impart the necessary functionality to apparatus. A handheld, transformable, multifunctional tool implement is disclosed comprising: an elongated, rigid, longitudinally-extending handle having a distal end and having a proximal end, the handle for transferring force from an operator's hands on the proximal end to a tool implement affixed to the distal end; a grip affixed to said proximal end for griping by the operator; a tool implement for one or more of digging, scoping, lifting, and spreading one or more of dirt, soil, mortar, mulch, snow, ice, gravel, sand and ore, wherein the handle is hingedly affixed to the to a reverse face of the tool implement such that the handle rotates axially about a hinge relative to the tool implement; the hinge affixed to the reverse face of the tool implement; and a locking mechanism for locking the handle in one of plurality of positions relative to the reverse face of the tool implement.

In some embodiments, the tool implement comprises a shovel body. In other embodiments, the tool implement comprises two different ground engaging edges on opposing ends of the shovel body, wherein each ground engaging edge can be positioned for ground engagement by rotating the shovel body on the hinge around the distal end of the handle.

The shovel body may comprise: a left lateral side; a right lateral side; a scrapper blade disposed between the lateral sides on a first distal end of the shovel body such that a scrapping edge of the blade runs in perpendicular fashion to a longitudinal axis defined by the length of the handle; a plow blade disposed between the lateral sides on a second distal end of the shovel body such that a forward edge of the plow runs perpendicularly to a longitudinal axis defined by the length of the handle; the reverse face affixed to the hinge; and an obverse face for receiving one or more of the dirt, soil, mortar, mulch, snow, ice, gravel, sand and ore.

The scrapper blade may be convex. The scrapper blade may further comprise a plurality of tines jutting from the edge of the scrapper blade. The scrapper blade and plow blade may be affixed to the shovel body using screw/bolt mechanism(s).

The hinge may comprise a mounting plate affixed to the reverse face of the shovel body using one or more of screws, bolts, and a weld. The reverse face of the shovel may comprise a planar top surface.

A second handheld, transformable, multifunctional shovel is also disclosed comprising: an elongated, rigid, longitudinally-extending handle having a distal end and having a proximal end, the handle for transferring force from an operator's hands on the proximal end to a tool implement affixed to the distal end; a rearward grip affixed to said proximal end for griping by the operator; a forward grip disposed between the proximal and distal ends on the handle; a shovel body for one or more of digging, scoping, lifting, and spreading one or more of dirt, soil, mortar, mulch, snow, ice, gravel, sand and ore, wherein the handle is hingedly affixed to a reverse face of the shovel body such that the handle rotates axially about a hinge relative to the shovel body, the shovel body comprising a left lateral side; a right lateral side; a convex scrapper blade disposed between the lateral sides on a first distal end of the shovel body such that a scrapping edge of the blade runs in perpendicular fashion to a longitudinal axis defined by the length of the handle, the scrapper blade affixed with a screw/bolt mechanism; a plow blade disposed between the lateral sides on a second distal end of the shovel body such that a forward edge of the plow runs perpendicularly to a longitudinal axis defined by the length of the handle, the plow blade affixed with a screw/bolt mechanism; the reverse face affixed to the hinge; and an obverse face for receiving one or more of the dirt, soil, mortar, mulch, snow, ice, gravel, sand and ore; the hinge affixed to the reverse face of the tool implement; and a locking mechanism for locking the handle in one of plurality of positions relative to the reverse face of the tool implement.

The scrapper blade and plow blade may be affixed to the shovel body using screw/bolt mechanism(s). The reverse face of the shovel may comprise a planar top surface. The tool implement may comprise two different ground engaging edges on opposing ends of the shovel body, wherein each ground engaging edge can be positioned for ground engagement by rotating the shovel body on the hinge around the distal end of the handle.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
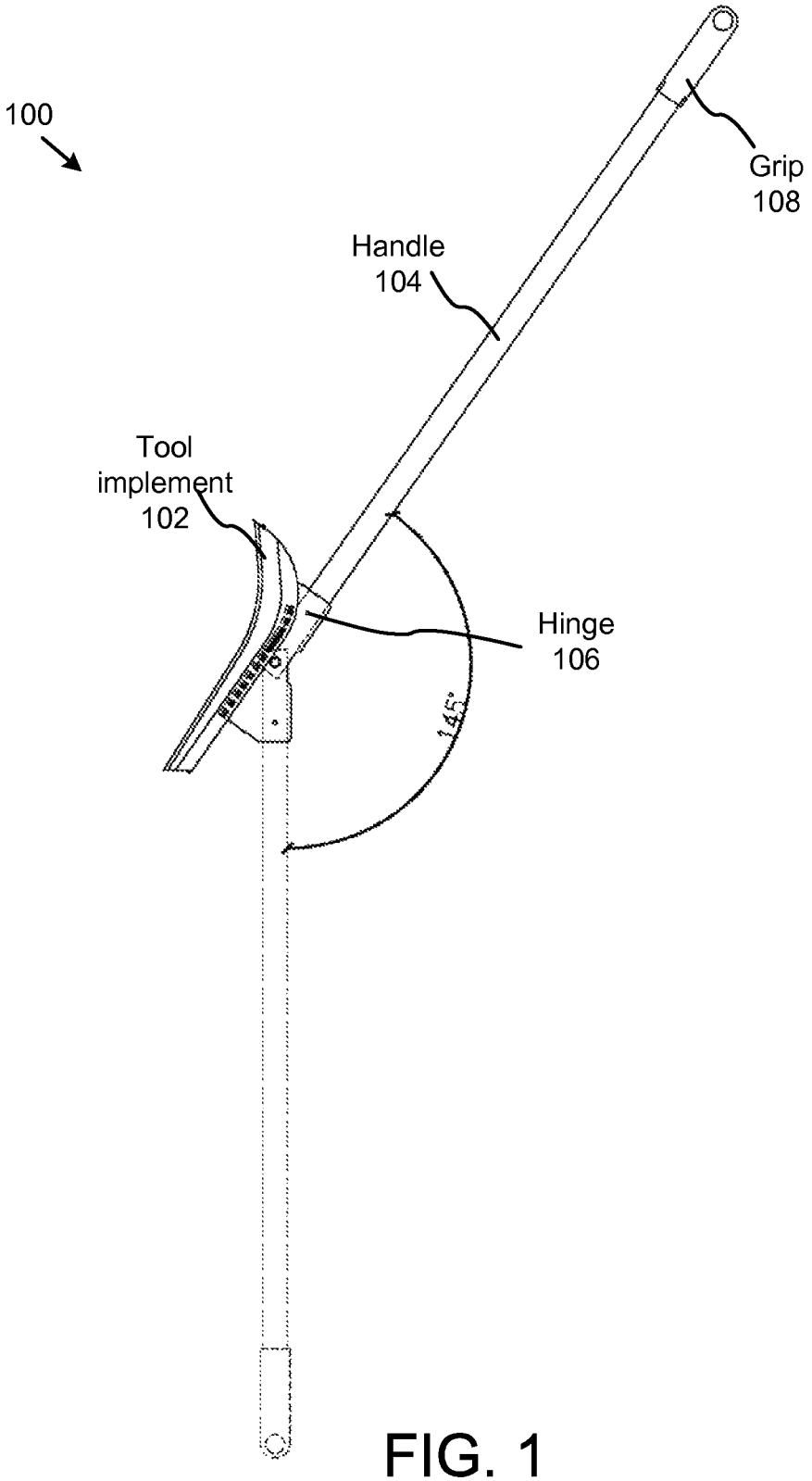
FIG. 1 is a side perspective view of one embodiment of a multifunction shovel in accordance with the present invention.

FIG. 1 is a side perspective view of one embodiment of a multifunction shovel 100 in accordance with the present invention. The multifunction shovel 100 comprises a tool implement 102, a handle 104, a hinge 106, and a grip 108.

In the shown embodiment, the tool implement 102 comprises a semi-convex shovel body or blade. The tool implement 102 may alternatively comprise an ice pick, squeegee, plow, scrapper, pitch fork, hoe, or the like.

In the shown embodiment, the tool implement 102 comprises a semi-convex obverse face for engaging and receiving aggregate, and reverse face which is affixed to the hinge 106.

The hinge 106 may comprise a semi-cylindrical housing for griping the handle 104.

The handle 104 comprises an elongated, cylindrical tube, bar, staff, pole, or the like, with a distal end affixed to the hinge 106 and a proximal end affixed to the grip 108. Generally, an operator will grip the handle 104 near the proximal end, or grip the handle 104 with one hand while gripping the grip 108 with the opposing hand, using both hands to transfer lifting force through the multifunction shovel 100 to the tool implement 102.

The handle 104 is affixed to the hinge 106 such that the tool implement 102 rotates around the distal end of the handle 104 through a range of 1 to 240 degrees. In the shown embodiment, the tool implement rotates through a range of 145 degrees.

Figure 2:
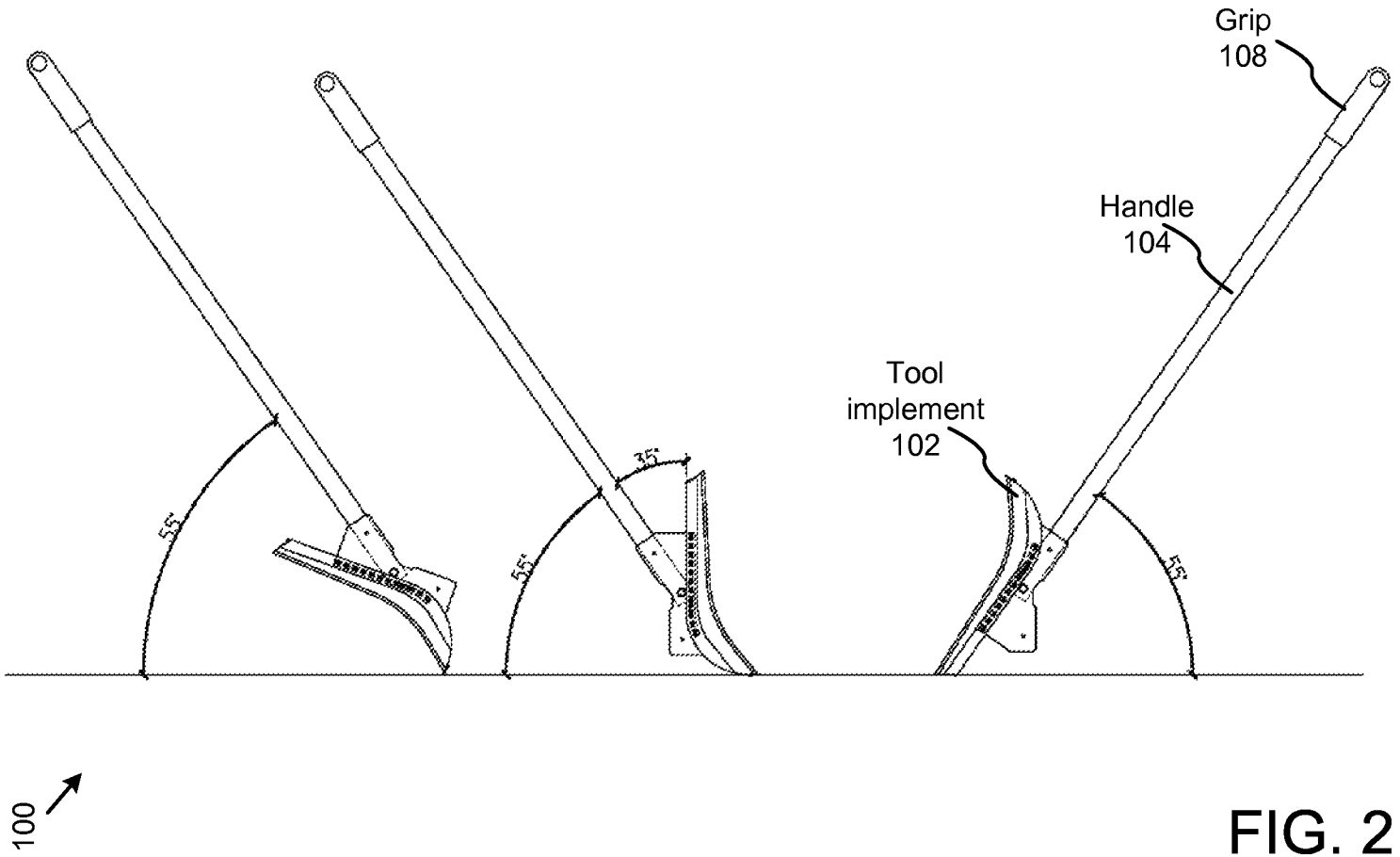
FIG. 2 is a side perspective view of another embodiment of a multifunction shovel transitioning from one configuration to another in accordance with the present invention.

FIG. 2 is a side perspective view of the multifunction shovel 100. In the shown embodiment, the shovel 100 is transitioning from one configuration to another in accordance with the present invention. Three phases A-C are shown. In the first phase (i.e. phase A), the shovel 100 is shown with the convex portion of the tool implement 102 in a down position (i.e. with the convex portion in distal position). The convex portion of the tool implement 102 in the shown embodiment comprises a scrapper along its leading edge.

Phase B shows the shovel 100 rotated axially about its longitudinal axis 180 degrees. This is the first step in reconfiguring the shovel 100.

An operator completes reconfiguration of the shovel 100 by rotating the handle 104 on the hinge 106 about the reverse face of the tool implement 102. In so doing, the convex portion of the tool implement 102 has now changed places with its opposing edge. The shovel 100 has been reconfigured so that planar section of the tool implement 102 is now disposed at the distal end of the tool implement 102, and ready for use by the operator.

In various embodiments, the hinge may comprise locking mechanisms known to those of skill in the art for locking the handle 104 in place as a predetermined angle relative to the implement body 102.

Figure 3A:
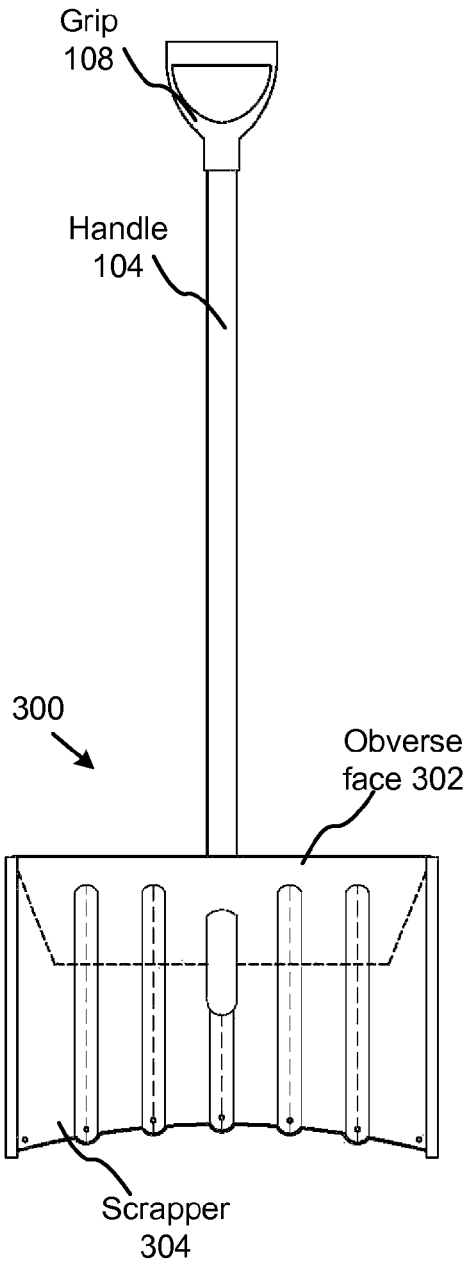
FIG. 3A is a front perspective view of another embodiment of a multifunction shovel in accordance with the present invention.

FIG. 3A is a front perspective view of another embodiment of a multifunction shovel 300 in accordance with the present invention. The shovel 300 comprises a handle 104, a grip 108, and a shovel body 102, which shovel body 102 comprises a scrapper 304 and an obverse face 302.

The handle 104 and grip 108 are substantially described above in relation to FIGS. 1-2.

The forward facing face of the shovel body 102 forms, in the shown embodiment, the obverse face 302 of the shovel body 102. Disposed distally on the shovel body 102, at the distal end of the longitudinal axis of the shovel 100, is the scrapper 304 for engaging ice and snow.

Figure 3B:
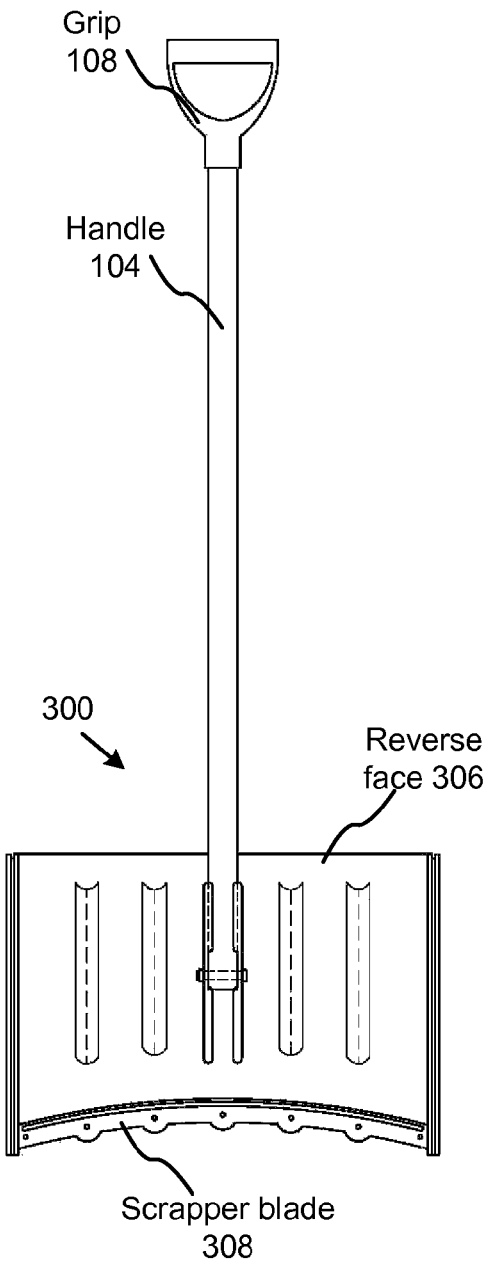
FIG. 3B is a rear perspective view of a multifunction shovel in accordance with the present invention.

FIG. 3B is a rear perspective view of a multifunction shovel 300 in accordance with the present invention. The shovel 300 comprises a handle 104, a hinge 106, a grip 108, and a shovel body 102, which shovel body 102 comprises a scrapper blade 308 and a reverse face 306.

The handle 104, hinge 106 and grip 108 are substantially described above in relation to FIGS. 1-3A.

The rearward facing face of the shovel body 102 forms, in the shown embodiment, the reverse face 306 of the shovel body 102.

Disposed distally on the shovel body 102, at the distal end of the longitudinal axis of the shovel 100, is the scrapper 304 for engaging ice and snow, which scrapper 304 comprises the shown scrapper blade 308.

The scrapper blade 308 comprises a metal sheet with a planar top surface and a planer bottom surface, having a convex lateral side. The scrapper blade 308 is detachably affixable to the shovel body 102 using one or more screw/bolt mechanisms, or through other means known to those of skill in the art. In some embodiments, the scrapper blade 308 is affixed to the reverse face 306. In other embodiments, the scrapper blade 308 is affixed to the obverse face 302.

Figure 3C:
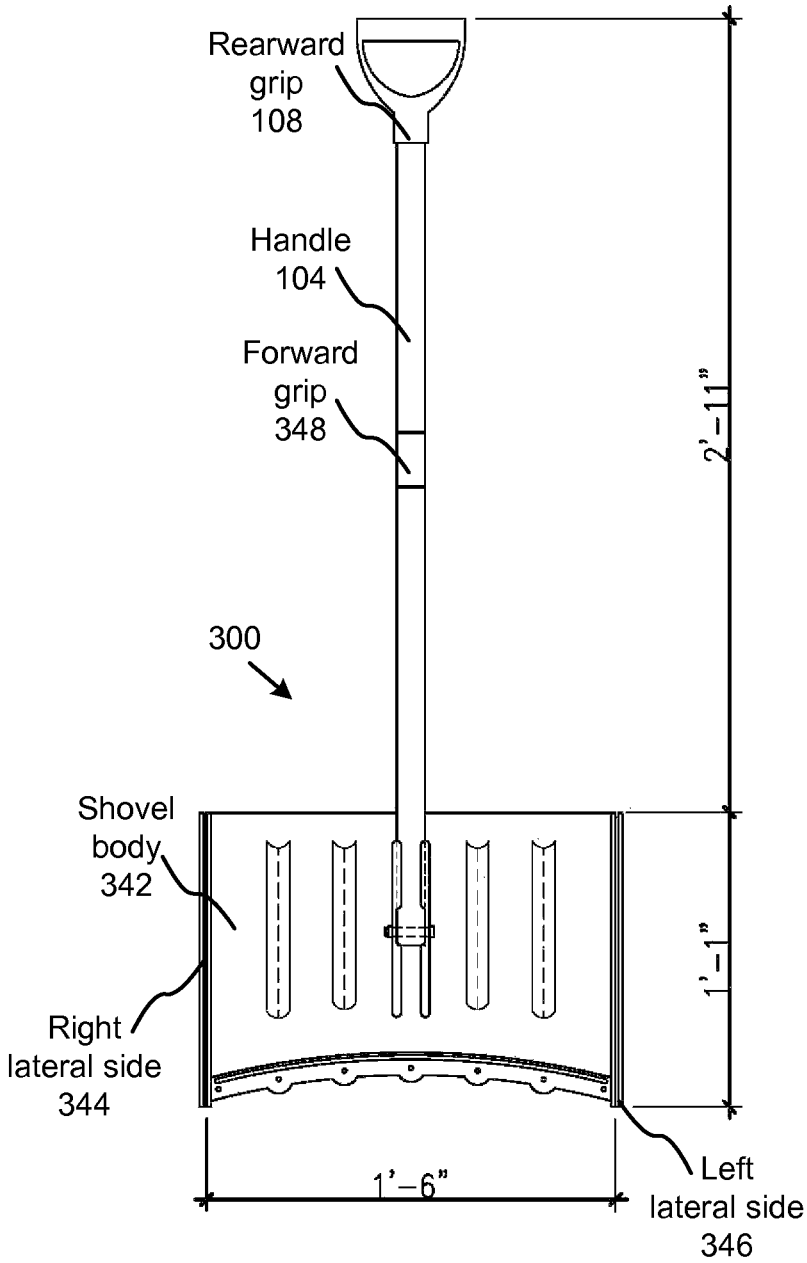
FIG. 3C is a rear perspective view of a multifunction shovel in accordance with the present invention.

FIG. 3C is a rear perspective view of a multifunction shovel 300 in accordance with the present invention. The shovel 300 comprises a handle 104, a hinge 106, a grip 108, and a shovel body 102, which shovel body 102 comprises a scrapper blade 308 and a reverse face 306.

The handle 104, hinge 106 and grip 108 are substantially described above in relation to FIGS. 1-3A.

The hinge 106 in the shown embodiment comprises a cylindrical housing disposed aft of the pivot axis of the hinge 106 for receiving the distal end of the handle 104. In various embodiments, the distal end of the handle 104 is affixed to the hinge 106 within the cylindrical body using screw/bolt mechanism, adhesive, clamps, or via other means known to those of skill in the art.

The shovel body 102 comprises a right lateral side 344 and a left lateral side 346. In the shown embodiments, the sides 344-346 rise outwardly away from the obverse face 302 of the shovel body 102. In some embodiments, the sides 344-346 comprise planar detachable metal sheets or bars.

Figure 4A:
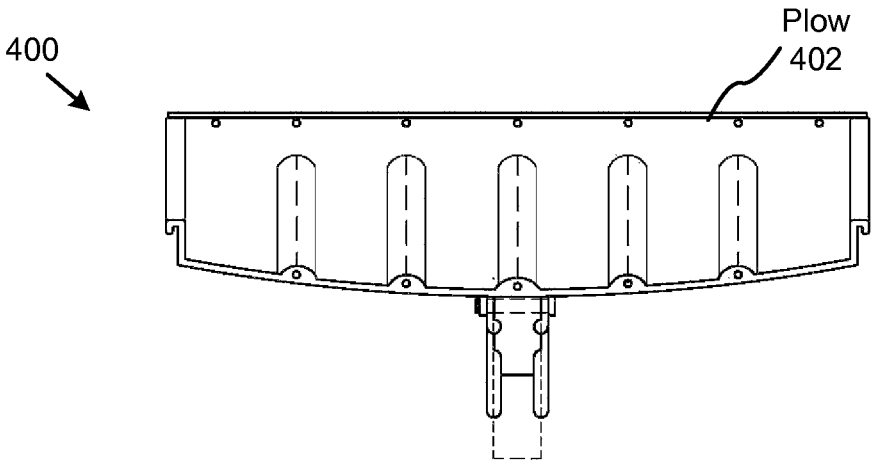
FIG. 4A is a top perspective view of a multifunction shovel in accordance with the present invention.

FIG. 4A is a top perspective view of a multifunction shovel 400 in accordance with the present invention. The shovel 400, in the shown embodiment, comprises a plow 402 for scooping up loosely packed snow and/or aggregate.

The plow 402 comprises a portion of the shovel body 102 which is flat across its surface with engages the snow and/or aggregate. Snow engaged by the plow 402 is forced upwardly into the convex portion of the shovel body 102.

Figure 4B:
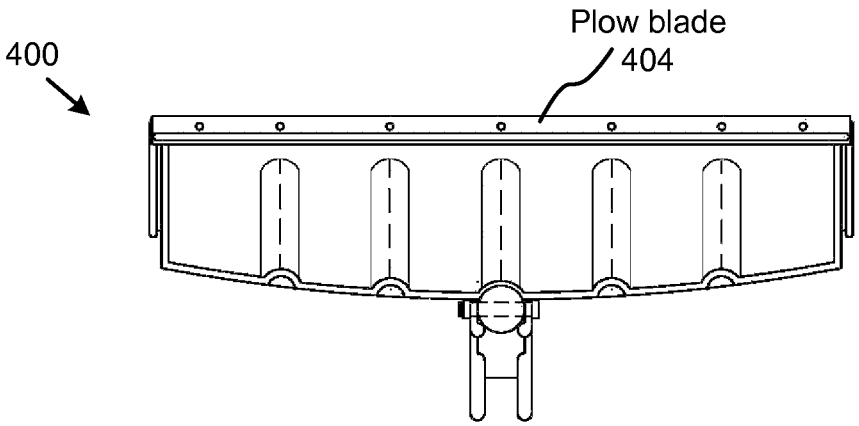
FIG. 4B is a lower perspective view of a multifunction shovel in accordance with the present invention.

FIG. 4B is a lower perspective view of a multifunction shovel 400 in accordance with the present invention. The shovel 400, in the shown embodiment, comprises the aforeidentified plow 402 which comprises a plow blade 404 for scooping up loosely packed snow and/or aggregate.

The plow blade 404, in the shown embodiment, underlies the plow 402 and the shovel body 102. The plow blade 404 is affixed to the underside (or reverse face) of the shovel body 102 using rivets, screws, bolts, adhesive, tracks, brackets, clamps or via other means known to those of skill in the art.

Figure 5A:
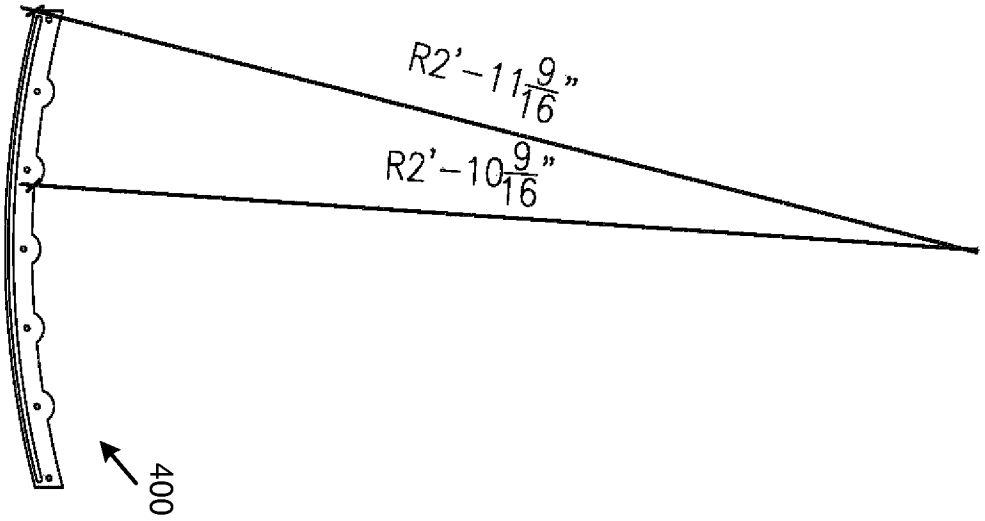
FIG. 5A is a top perspective view of a detached blade of a scoop of a multifunction shovel in accordance with the present invention.

FIG. 5A is a top perspective view of a detached blade 308 of a scoop of a multifunction shovel 400 in accordance with the present invention. The detached scoop blade 308 is convex through its leading edge for scooping and/or scrapping snow, ice and/or aggregates, and directing the same toward the center of the blade 308. In some embodiments the blade may be concave through its leading edge. Like the plow blade 404, the scoop blade 308 is affixed to the shovel body 102 using rivets, screws, bolts, adhesive, tracks, brackets, clamps or via other means known to those of skill in the art.

Figure 5B:
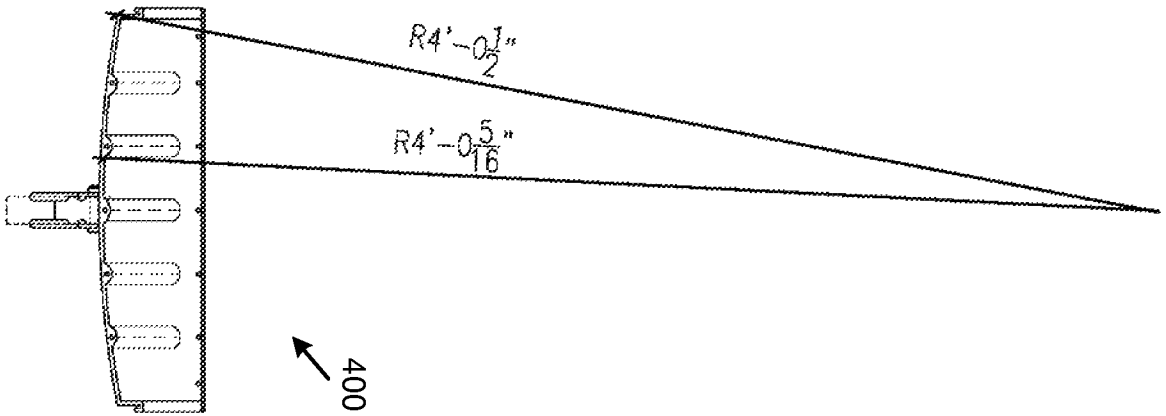
FIG. 5B is a top perspective view of an attached blade of a scoop of a multifunction shovel in accordance with the present invention.

FIG. 5B is a top perspective view of an attached blade 308 of a scoop of a multifunction shovel 400 in accordance with the present invention.

The blade 308 is disposed as shown on the shovel 400, with the shown measurements and dimensions.

Figure 6A:
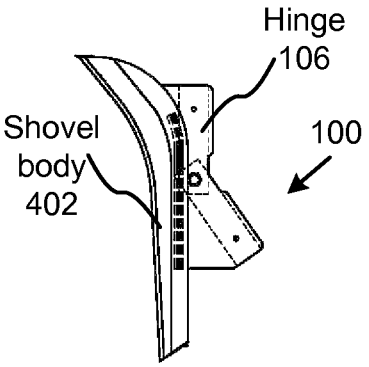
FIG. 6A is a side perspective view of a multifunction shovel in accordance with the present invention.

FIG. 6A is a side perspective view of a multifunction shovel 100 in accordance with the present invention.

Figure 6B:
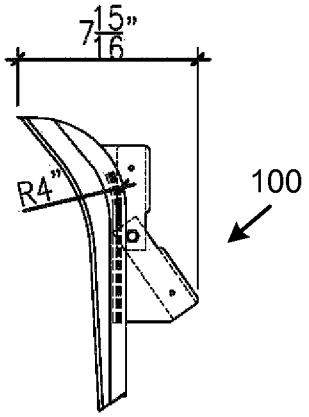
FIG. 6B is a side perspective view of a multifunction shovel in accordance with the present invention.

FIG. 6B is a side perspective view of a multifunction shovel 100 in accordance with the present invention, showing measurement and dimension of one embodiment.

Figure 7:
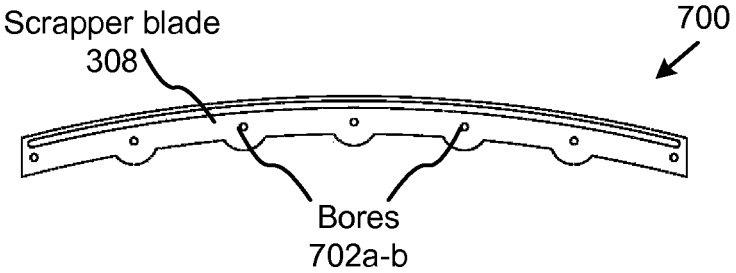
FIG. 7 is a top perspective view of the blade of a scrapper of a multifunction shovel in accordance with the present invention.

FIG. 7 is a top perspective view of the scrapper blade 308 of a plow of a multifunction shovel 400 in accordance with the present invention. As shown, the scrapper blade 308 comprises bore holes, or apertures, in the shown embodiment, for receiving screws, bolts, rivets, or the like, and detachably affixing the scrapper blade 308 to the shovel body 102.

Figure 8:
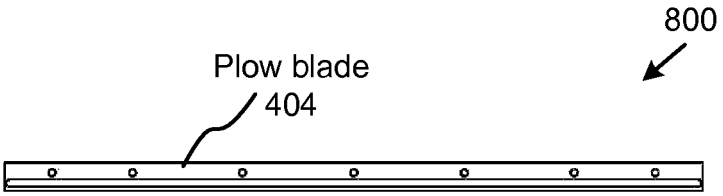
FIG. 8 is a top perspective view of the blade of a plow of a multifunction shovel in accordance with the present invention.

FIG. 8 is a top perspective view of the blade 404 of a plow 402 of a multifunction shovel 400 in accordance with the present invention. As shown, the plow blade 404 comprises bore holes, or apertures, in the shown embodiment, for receiving screws, bolts, rivets, or the like, and detachably affixing the plow blade 404 to the shovel body 102. In other embodiments, both the plow blade 404 and/or the scrapper blade 308 may slide onto a cantilevered lip of the shovel body 102 acting as a track.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A handheld, transformable, multifunctional tool implement comprising:

an elongated, rigid, longitudinally-extending handle having a distal end and having a proximal end, the handle for transferring force from an operator's hands on the proximal end to a tool implement affixed to the distal end;

a grip affixed to said proximal end for griping by the operator;

the tool implement having a ground-engaging edge for one or more of digging, scoping, lifting, and spreading one or more of dirt, soil, mortar, mulch, snow, ice, gravel, sand and ore, wherein the handle is hingedly affixed to the to a reverse face of the tool implement such that the handle rotates axially about a hinge relative to the tool implement through a range 1 to 240 degrees, wherein axial rotation of the handle changes the ground-engaging edge of the tool implement to an opposing edge on the tool implement;

the hinge affixed to the reverse face of the tool implement;

a locking mechanism for locking the handle in one of plurality of positions relative to the reverse face of the tool implement; and wherein the shovel body comprises a left lateral side; a right lateral side; a scrapper blade disposed between the lateral sides on a first distal end of the shovel body such that a scrapping edge of the blade runs in perpendicular fashion to a longitudinal axis defined by the length of the handle; a plow blade disposed between the lateral sides on a second distal end of the shovel body such that a forward edge of the plow runs perpendicularly to a longitudinal axis defined by the length of the handle, the plow blade for engaging a ground surface when the handle is rotated; the reverse face affixed to the hinge; and an obverse face for receiving one or more of the dirt, soil, mortar, mulch, snow, ice, gravel, sand and ore.

2. The implement of claim 1, wherein the tool implement comprises two different ground engaging edges on opposing ends of the shovel body, wherein each ground engaging edge can be positioned for ground engagement by rotating the shovel body on the hinge around the distal end of the handle.

3. The implement of claim 1, wherein the scrapper blade is convex.

4. The implement of claim 1, wherein the scrapper blade and plow blade are affixed to the shovel body using screw/bolt mechanism(s).

5. The implement of claim 1, wherein the reverse face of the shovel comprises a planar top surface.

6. The implement of claim 1, wherein the handle locks into a bracket affixed on the reverse face.

* * * * *